United States Patent [19]

Meyer

[11] Patent Number: 4,563,158

[45] Date of Patent: Jan. 7, 1986

[54] FUEL IGNITION DEVICE AND METHOD OF ASSEMBLING SAME

[75] Inventor: Helmut P. Meyer, Sidney, N.Y.

[73] Assignee: Allied Corporation, Morristown, N.J.

[21] Appl. No.: 488,949

[22] Filed: Apr. 27, 1983

[51] Int. Cl.[4] ..... H01T 21/02

[52] U.S. Cl. ..... 445/7

[58] Field of Search ..... 445/7; 313/137

[56] References Cited

U.S. PATENT DOCUMENTS

| | | | |
|---|---|---|---|
| 1,835,574 | 12/1931 | Rabezzana | 445/7 |
| 2,136,206 | 11/1938 | Dukelow | 313/137 |
| 2,525,536 | 10/1950 | Faatz et al. | 123/69 |
| 2,898,395 | 8/1959 | Schurecht | 445/7 |
| 2,933,631 | 4/1960 | Logan | 445/7 |
| 3,013,174 | 12/1961 | Logan | 445/7 |
| 3,229,032 | 1/1966 | Willis | 174/52 |
| 3,295,005 | 12/1966 | Poellet et al. | 445/7 |
| 3,581,141 | 5/1971 | Beaubier | 313/130 |
| 3,967,149 | 6/1976 | Eaton et al. | 445/7 |
| 3,995,184 | 11/1976 | Insley | 445/7 |
| 4,097,977 | 7/1978 | Pollner | 445/7 |
| 4,110,667 | 8/1978 | Graf Vom Hagen | 445/7 |
| 4,497,633 | 2/1985 | Meyer | 445/7 |

*Primary Examiner*—Kenneth J. Ramsey
*Assistant Examiner*—Kurt Rowan
*Attorney, Agent, or Firm*—B. L. Lamb; R. M. Trepp

[57] ABSTRACT

A fuel ignition plug (10) includes an outer electrode (12) defined by a conductive shell which surrounds a central electrode (28) and an insulator body (22) between the central electrode (28) and outer electrode (12). Fused glass powder seals (40,42) between the shell and the insulator body (22), and between the insulator body (22) and the central electrode (28), prevent combustion gasses from passing through the interior of the device (10). The device (10) is assembled by holding the electrodes (12,28) and insulator body (22) in fixed, concentric relationship with each other while the seals (40,42) are heated and extruded into sealing position against a shoulder (38,52) of the insulator body (22). The seals (40,42) are extruded into sealing position by applying force to push rings (44,46) which are respectively sleeved over the insulator body (22) and central electrode (28) and bear against the seals (40,42).

2 Claims, 3 Drawing Figures

FUEL IGNITION DEVICE AND METHOD OF ASSEMBLING SAME

The present invention generally relates to devices for igniting fuel and deals more particularly with an ignition device having internal seals which prevent the passage of combustion gasses through the interior of the device, as well as a method of assembling the device.

Spark discharge devices for igniting fuel in an engine such as a gas turbine employ internal pressure seals in order to prevent the escape of gasses from the engine. These plugs include an electrically conductive, cylindrical shell, a central electrode coaxially disposed within the shell and a dielectric insulator internally seated within the shell and surrounding the central electrode. An annular spark discharge gap is defined at one end of the device, between the central electrode and the end of the shell. The insulator electrically insulates the central electrode from the conductive shell. In order to obtain high dielectric strength in the insulator, a solid ceramic insulator is normally employed which extends substantially the entire length of the device.

In order to prevent the passage of gasses through the device, an outer seal is provided between the insulator and the shell and an inner seal is provided between the insulator and the central electrode. The seals comprise compacted glass powder which are presintered to a desired configuration, and for purposes of the present disclosure, the material from which the seals are produced will be referred to as glass powder. In assembling the prior art devices, the outer seal is prepositioned between an internal shoulder of the shell and an external shoulder of the insulator, and the inner seal is prepositioned between an internal shoulder of the insulator and an external shoulder of the electrode. Upon the external application of heat to the shell in the vicinity of the seals, and simultaneous application of force, in opposite directions, against the insulator and the shell, both the insulator and central electrode are displaced toward the firing end of the shell until the insulator seats against a shoulder in the shell. While the insulator and central electrode are being displaced, the glass powder becomes fused and is extruded to form the seals.

The assembly process described above is less than completely satisfactory for several reasons. In some cases, the insulators fail to seat completely against the shoulder of the shell, resulting in the failure of the assembly to meet preselected dimensions, unsatisfactory contact between the insulator and the shell seat, and eccentric location of the central electrode relative to the shell, i.e., a non-uniform firing gap. There appear to be several reasons for the adverse results mentioned above including surface finishes on mating parts which result in excessive friction, improper alignment of fixturing which causes eccentric loading during the fusing process; however, the primary reason resides in the fact that the glass powder seals having a considerably greater axial length (thickness) than the space that the extruded glass occupies after fusing. This latter mentioned cause means that the insulator cannot be in an engaged or seated position with the shell prior to fusing of the glass powder.

DISCLOSURE OF THE INVENTION

The present invention overcomes each of the disadvantages of the prior art discussed above by providing an ignition device which may be assembled in a manner that assures concentricity between the shell and the central electrode. The ignition device is characterized by an inner and outer push ring which are employed to transmit force to the inner and outer seals during extrusion thereof while the shell and central electrode are maintained in a concentric, assembled position.

Accordingly, it is an advantage of this invention to provide a method for assembling an ignition device which obviates the need for displacing the central electrode and insulator relative to the shell during heating and extrusion of the seals.

Another advantage of this invention lies in the use of annular shoulders in the insulator against which the seals may be extruded.

Another advantage of the invention involves the use of push rings to transmit force to the seals in order to extrude the seals into sealing position.

Another advantage of this invention is that it eliminates scrap and rework of ignition devices due to the central electrode and insulator failing to seat properly relative to the shell.

DETAILED DESCRIPTION OF THE INVENTION

Figure 1:
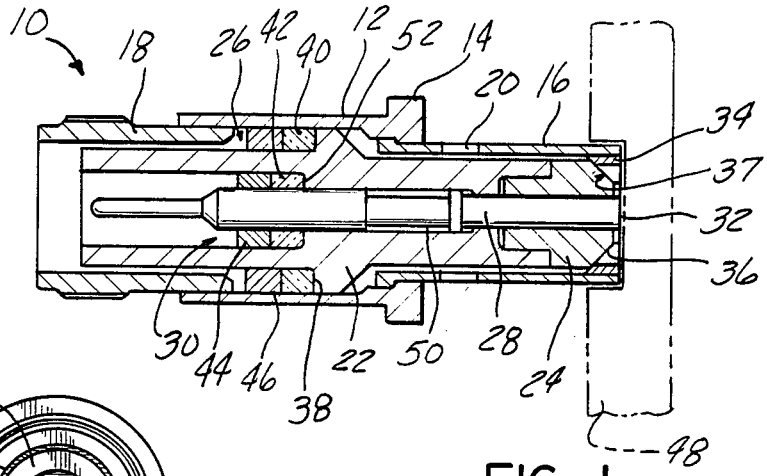
FIG. 1 is a longitudinal, sectional view of the ignition device of the present invention, shown in a fully assembled position within a fixture.

Referring now to the drawings, FIG. 1 illustrates a fuel ignition device 10 having the firing end thereof disposed within a cylindrical depression in a fixture 48 employed for assembling the device 10. Ignition device 10 includes a generally cylindrical outer shell 12 of conductive material, a central electrode 28 concentrically disposed within shell 12 and an insulator body 22 surrounding the central electrode 28 and electrically insulating electrode 28 from the shell 12.

Shell 12 includes a cylindrically shaped forward portion 16, the outer end of which defines an outer, annularly shaped electrode surrounding the end 32 of central electrode 28. The other end of shell portion 16 is secured as by brazing or the like to the inside wall of a tubular intermediate portion 14 of shell 12, however, shell portions 14 and 16 may be of a single unitary construction if desired. A third portion 18 of the shell 12 is also substantially cylindrical and has one end thereof sleeved inside shell portion 14 and secured thereto as by brazing. The firing end of the forward shell portion 16 includes an inwardly, extending shoulder 36 which includes a bevelled surface 37 that is inclined relative to the longitudinal axis of the central electrode 28. Shoulder 36 includes a plurality of circumferentially spaced, longitudinally extending cooling passageways 34 therein. Shell portion 16 also includes a plurality of circumferentially spaced cooling apertures 20 in the sidewall thereof, spaced rearwardly from the firing end of the device 10.

The insulator body 22 is preferably formed of ceramic or other suitable insulating material and includes a forward portion 24 having a circumferentially extending, bevelled surface which conformingly contacts and seats against the surface 36, thereby concentrically positioning the insulator body 22 within the shell 12. Insulator body 22 includes a longitudinally extending bore 50 therein through which the central electrode 28 extends.

The bore 50 is of increased diameter at the rear of the device 10 to define an annularly extending space 30 circumscribing the central electrode 28 and an annular shoulder 52. The outer circumferential surface of the aft end of insulator body 22 is cut away so as to define an annularly extending space 26 between the insulator body 22 and shell portion 14 as well as an annular shoulder 38.

Outer and inner seals 40,42 are respectively disposed within the outer and inner annular spaces 26,30 and seat against the corresponding shoulders 38,52. Seals 40,42 may comprise presintered preforms of glass powder which are fused by the application thereto of heat and extruded as will be discussed in more detail below. Outer seal 40 seals the interface between the outer surface of insulator body 22 and the interior wall of shell portion 14. Inner seal 42 provides a gas tight seal between the central electrode 28 and the interior wall of the insulator body 22 defining the bore 50. Inner and outer push rings 44 and 46 respectively disposed in annular spaces 30 and 26 are employed during assembly of the ignition device 10 to transmit force to the seals 42,40.

Figure 2:
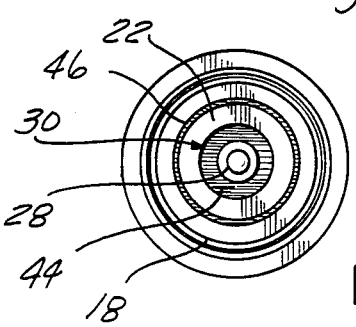
FIG. 2 is a view of the end of the ignition device shown in FIG. 1, opposite the firing end thereof.

FIG. 2 depicts the end of the ignition device 10 which is adapted to be connected with an electrical connector for supplying electrical power to the device 10. The annular inner space 30 surrounding the central electrode 28 is adapted to receive the male portion of an electrical connector (not shown), such connector also being adapted to mate with the corresponding end of the shell portion 18.

Figure 3:
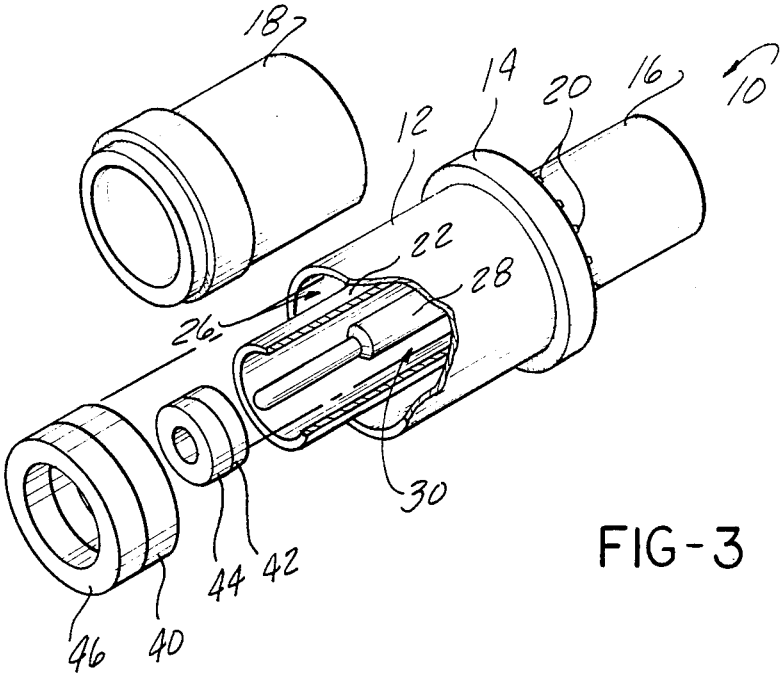
FIG. 3 is a perspective, exploded view of the ignition device shown in FIG. 1.

FIG. 3 shows the ignition device 10 during assembly thereof, which will now be described in detail. With shell portions 14 and 16 secured together, the outer end of shell portion 16 is inserted into a depression in fixture 48 so as to longitudinally immobilize the shell 12 and provide a stop surface at the outer end of shell portion 16 for longitudinally locating the firing end 32 of the central electrode 28 relative to the outer end of shell portion 16. With the shell 12 held in the fixture 48, the assembly of the insulator body 22 and central electrode 28 is passed longitudinally into and through the shell 12 until the firing end 32 of central electrode 28 engages the fixture 48 and the end 24 of insulator body 22 engages bevelled surfaces 37. This latter mentioned step may be completed by inserting the central electrode 28 into the insulator body 22 either before or after insulator body 22 is installed within the shell 12.

Next, seals 40 and 42 are respectively sleeved over the end of insulator body 22 and central electrode 28 following which the push rings 44 and 46 are likewise sleeved over the central electrode 28 and the outer end of insulator body 22. Longitudinal force is then applied to the push rings 44,46 until the corresponding seals 40 and 42 engage the corresponding shoulders 52,38. At this point, heat is applied locally around the intermediate portion 14 of the shell 12 to the area adjacent the seals 40,42 in order to heat and thereby fuse the glass powder in seals 40,42. Heating is continued until the glass powder becomes fused at which time further longitudinal pressure is applied to the push rings 44,46 thereby extruding the associated seals 42,40 to create gas tight seals between the insulator body 22 and the electrode 28 as well as the shell 12. During the heating and extrusion of seals 40,42 the insulator body 22 and electrode 28 remain stationary and perfectly concentric within the shell 12, due to the fact that the forward end 24 of insulator body 22 is seated against the shoulder 36 and the firing end 32 of electrode 28 is seated against the fixture 48.

Following fusion and extrusion of the seals 40,42, the assembly process is completed by inserting one end of shell portion 18 into the interior of shell portion 14, and joining these shell portions, as by brazing or the like.

While a preferred embodiment of this invention has been disclosed, it will be apparent to those skilled in the art, that changes may be made to the invention as set forth in the appended claims, and in some instances, certain features of the invention may be used to advantage without corresponding use of other features. Accordingly, it is intended that the illustrative and descriptive materials herein be used to illustrate the principles of the invention and not to limit the scope thereof.

I claim:

1. A method of assembling a spark discharge fuel ignition device of the type including the combination of a conductive tubular shell having a shoulder (in) at one end thereof and defining an annularly shaped outer electrode, the surface of said shoulder extending from the inner wall of said shell being inclined toward said one end of said shell, an elongated central electrode coaxially disposed within said shell, one end of said electrode being coterminous with said one end of said shell, an insulator within said shell for insulating said central electrode from said shell, said insulator having a longitudinally extending bore therein through which said central electrode extends, one end of said insulator having a circumferential bevelled surface adapted to contact conformingly said inclined surface of said shoulder, a first annular glass powder bead seal between said shell and said insulator for preventing combustion gasses from passing between said shell and said insulator and a second annular glass powder bead seal between said insulator and said central electrode for preventing combustion gasses from passing between said insulator and said central electrode, comprising the steps of:

(A) positioning said tubular shell with said one end thereof in abutment with a stop fixture;

(B) installing said insulator within said shell with said one end of said insulator seated against said inclined surface of said shoulder;

(C) positioning said central electrode within said bore with said one end of said electrode abutting said stop fixture at said one end of said shell;

(D) sleeving said first and second seals respectively over the ends of said insulator and said central electrode opposite said one ends of said insulator and said central electrode;

(E) sleeving first and second push rings respectively over the ends of said insulator and said central electrode opposite said one ends of said insulator and said central electrode;

(F) applying longitudinal force to said first and second push rings to move said push rings into engagement with said seals and to maintain said one ends of said shell and said central electrode in engagement with said stop fixture; and (G) heating said first and second seals to a temperature sufficient to fuse the powder of said seals while maintaining said longitudinal force on said first and second push rings.

2. A method as claimed in claim 1 with the additional step of:

(H) increasing said longitudinal force while said first and second seals are being heated to extrude to extrude said first seal into intimate contact with said shell and said insulator and to extrude said second seal into intimate contact with said insulator and said central electrode.

* * * * *